United States Patent [19]

Lang

[11] Patent Number: 4,961,506

[45] Date of Patent: Oct. 9, 1990

[54] MULTI-TIER TOWER FOR GOODS DISPLAY

[75] Inventor: Franz J. Lang, Kelkheim, Fed. Rep. of Germany

[73] Assignee: Display-Design GmbH fur moderne Verkaufsforderungsmittel und Raumausstattung, Kelkheim, Fed. Rep. of Germany

[21] Appl. No.: 207,254

[22] Filed: Jun. 15, 1988

[30] Foreign Application Priority Data

Jun. 30, 1987 [DE] Fed. Rep. of Germany ..... 3721559
May 13, 1988 [EP] European Pat. Off. ..... 88107757.2

[51] Int. Cl.[5] ..... A47B 47/00

[52] U.S. Cl. ..... 211/188; 108/91; 108/111; 211/186

[58] Field of Search ..... 211/188, 189, 186, 194; 206/503; 312/107, 111; 108/91, 111; 403/402, 401, 295, 293

[56] References Cited

U.S. PATENT DOCUMENTS

| | | | |
|---|---|---|---|
| 2,522,442 | 9/1950 | Garris | 211/186 X |
| 2,582,557 | 1/1952 | Palkman | 211/186 X |
| 3,648,849 | 3/1972 | Harris et al. | 206/503 X |
| 3,780,386 | 12/1973 | Fouks et al. | 211/186 X |
| 3,834,324 | 9/1974 | Lang | 211/188 X |
| 3,927,625 | 12/1975 | Lang | 108/111 X |
| 4,428,487 | 1/1984 | Hepp | 211/188 X |
| 4,442,778 | 4/1984 | Lang | 211/186 X |
| 4,738,039 | 4/1988 | Sun et al. | 403/402 X |

FOREIGN PATENT DOCUMENTS

| | | |
|---|---|---|
| 0035668 | 4/1985 | European Pat. Off. . |
| 2153603 | 5/1973 | Fed. Rep. of Germany . |
| 3006377 | 8/1981 | Fed. Rep. of Germany . |
| 3016962 | 11/1981 | Fed. Rep. of Germany . |

*Primary Examiner*—David L. Talbott
*Assistant Examiner*—Daniel Hulseberg
*Attorney, Agent, or Firm*—Brumbaugh, Graves, Donohue & Raymond

[57] ABSTRACT

A multi-tier tower has at least two successive tier trays and at least one spacing support connecting the tier trays, the spacing support being coupled with the respective tier tray at each of its two ends. The coupling is formed so that uncoupling of the tier tray from the support is possible in a horizontal direction, i.e. transverse to the direction of the height of the multi-tier tower.

40 Claims, 11 Drawing Sheets

Fig. 2
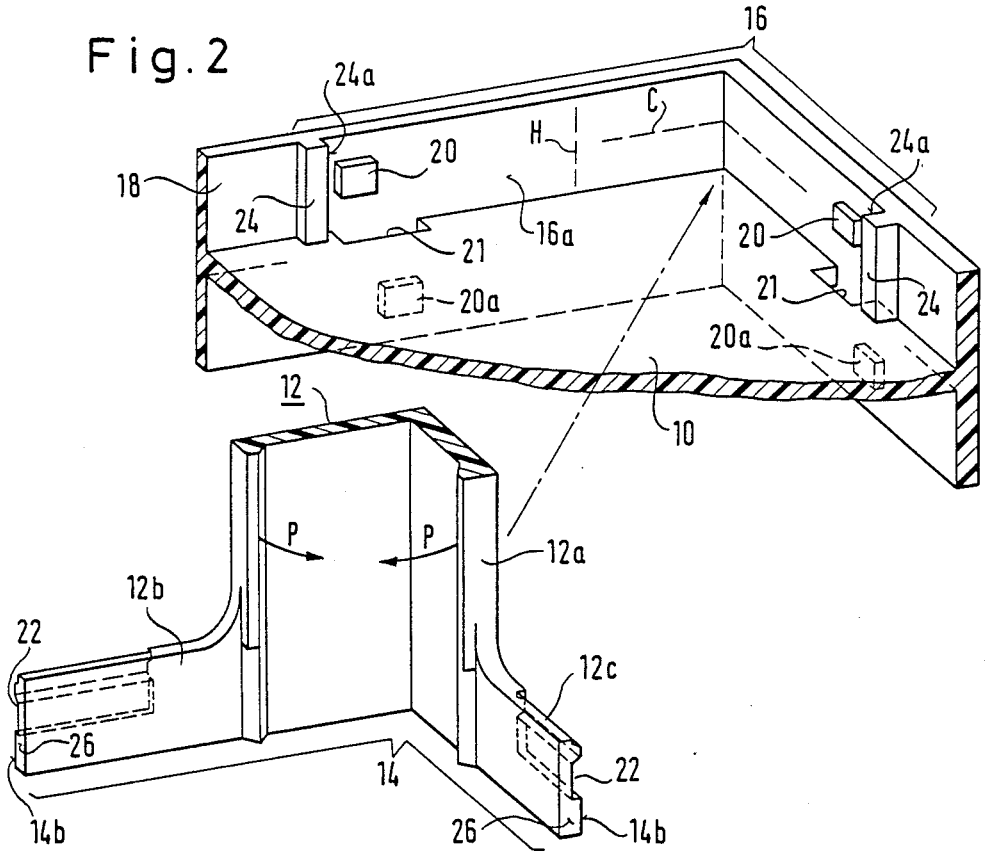
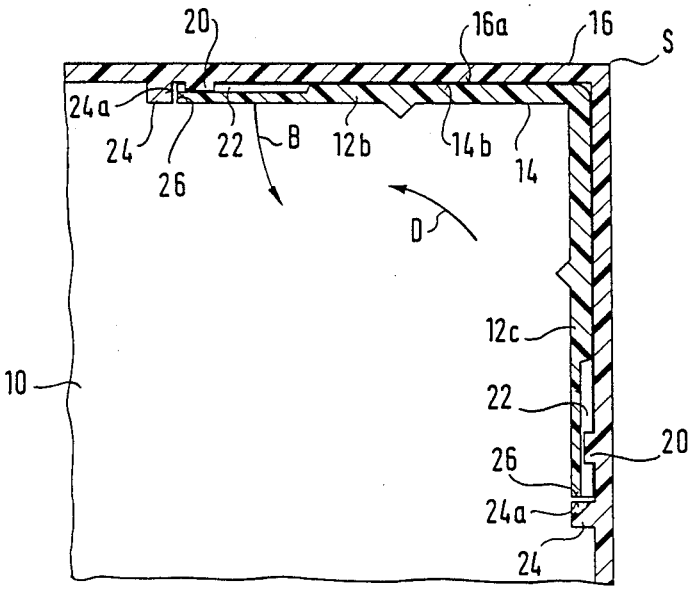
Fig. 3

MULTI-TIER TOWER FOR GOODS DISPLAY

BACKGROUND OF THE INVENTION

This invention relates to a multi-tier tower for goods display having a plurality of tier trays or tier plates and having at least one vertical spacing support between each two successive tier trays, with one end of the spacing support being detachably coupled to the respective tier tray. The tier tray and spacing support are coupled in a manner such that an outer curve or angle element with a horizontally extending line of curvature and a vertically extending surface line is fitted on either the tier tray or the spacing support, and an inner curve or angle element with a horizontally extending line of curvature and a vertically extending surface line is arranged on either the complementary spacing support or tier tray, respectively. The inner curve or angle element, which rests with its outer face abutting the inner face of the outer curve or angle element, is held firmly in the direction of both the line of curvature and the surface line by an engageable and disengageable shape-engaging connection.

STATEMENT OF THE PRIOR ART

A multi-tier tower is disclosed in DE-PS No. 2,153,603, in which an inner, right-angled angle element is fitted on each of the two ends of the spacing support. An outer, right-angled angle element is situated on the respective tier tray and is formed by part of an upwardly and downwardly protruding edge flange of the tier tray. The inner abutment face of the outer angle element is set back in relation to the remainder of the inner circumferential surface of the edge flange, thereby forming stop faces on the outer angle element. On the side of the inner angle element remote from the outer angle element there lies a third angle element which, together with the outer angle element, forms a shaft on the tier tray concerned. The inner angle element can be pushed in a vertical direction into this shaft. On the circumferentially spaced ends of the inner angle element there are provided wedge dogs which, after the complete pushing of the inner angle element into the shaft, snap positively into corresponding dog sockets on the inner side of the outer angle element. To release the coupling between the inner angle and the outer angle elements, it is necessary to lift the ends of the inner angle element away from the inner surface of the outer angle element to such an extent that the wedge-shaped engagement dogs disengage from the recesses. The spacing support may thereafter be pushed with the inner angle element out of the shaft in a vertical direction.

The above-described multi-tier tower has on the whole proven its value. However, it is relatively difficult to achieve coupling and especially uncoupling of the abovedescribed tier tray and spacing support. Coupling and uncoupling is especially difficult when there are two or more spacing supports present between two successive tier trays. In this embodiment, which is also of special interest within the scope of the present invention, the difficulty exists in that the uncoupling of a spacing support between two successive tier trays, when one or more further spacing supports are still present between these two tier trays, subjects the connections between the further spacing supports still present and the tier trays to bending stress, if bending is possible at all. If such bending is not possible, then all spacing supports, at least at one end, would have to be disengaged simultaneously from their respective tier trays. This is difficult even for a skilled person, especially if, for example, four spacing supports are present.

A similar problem exists in the multi-tier tray tower disclosed by DE-OS 3,006,377, which comprises spacing supports of channel form having ends on which there are formed inner curve elements which co-operate with outer curve elements formed by a surrounding flange of the tier tray, in the same manner as described above for DE-PS No. 2,153,603.

OBJECT OF THE INVENTION

The object of this invention is to provide a multi-tier tower wherein the coupling and uncoupling of the spacing support ends with the tier trays or plates is facilitated.

SUMMARY OF THE INVENTION

This invention is directed to a multi-tier tower having at least two successive tier trays and at least one spacing support connecting the tier trays. The tier tray and spacing support are coupled such that the curve or angle element of the spacing support is exposed on the side remote from the curve or angle element of the tier tray in such a way that the spacing support can be fastened or released in relation to the curve or angle element of the tier tray or tier plate solely by horizontal movement. As a result, it is possible to dispense completely with push-in shafts on the tier tray; nevertheless, a stable coupling of the spacing support ends with the tier trays may be achieved.

According to one embodiment of this invention, the outer and the inner curve or angle elements may have an approximately right-angled cross-section. This embodiment may especially be employed if square or rectangular tier trays are to be connected with one another by two or four spacing supports.

According to another embodiment of this invention, the inner curve or angle element and the outer curve or angle element are each formed with approximately partcircular cross-sections, with semi-circular cross-sections being particularly preferred. This embodiment is especially preferred if it is intended to connect two spacing supports of channel form with one another as disclosed in DE-OS No. 3,006,377.

Fundamentally, this invention is directed to every kind of connection between tier trays and spacing supports in which the inner and outer curve or angle elements are secured to one another by connections of the press-stud type.

In yet another embodiment of this invention, directed to rectangular or square formation of the tier trays, spacing supports are provided only in two mutually adjacent corners. This embodiment achieves a multi-tier tower which guarantees optimum view and optimum access to the stored goods.

Further, the tier tray (10) and/or the spacing support (12) may be moulded in one piece each from synthetic plastic material, especially transparent synthetic plastic material.

BRIEF DESCRIPTION OF THE DRAWINGS

The invention is explained by reference to examples of various embodiments of this invention as depicted by the accompanying drawings, wherein:

FIG. 2 shows the coupling zones at one end of a spacing support and on one side of a tier tray, in exploded representation;

FIG. 3 shows the engagement of an inner angle element of a spacing support in an outer angle element of a tier tray in horizontal section;

DESCRIPTION OF THE PREFERRED EMBODIMENTS

Figure 1:
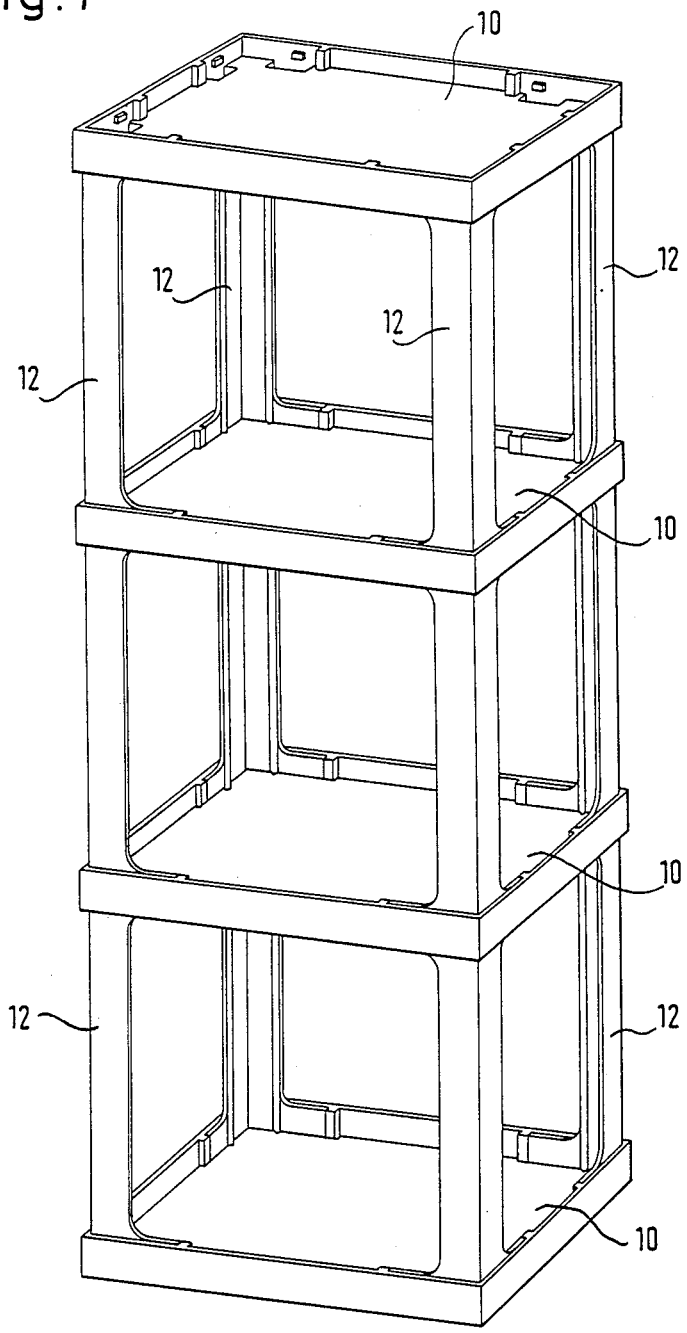
FIG. 1 shows an embodiment of a multi-tier tower of rectangular cross-section.

FIG. 1 depicts a multi-tier tower which has a plurality of tier trays 10 with four spacing supports 12 located between each two successive tier trays 10.

FIG. 2 depicts the lower end of a spacing support 12 in position to be coupled with opposing tier tray 10. On the lower end of the spacing support 12, an inner angle element 14 is fitted which stands opposite to an outer angle element 16 on the tier tray 10. The inner angle element 14 is formed by the shank **12*a* and horizontal continuations 12*b* and 12*c* of the spacing support 12. The outer angle element 16 is part of an encircling flange 18 which extends along the edge of the tier tray 10 and protrudes upwards and downwards. One end of the spacing support 12 is typically coupled to the respective tier tray 10 by means of an outer curve or angle element 16 with horizontally extending line C of curvature and vertically extending surface line H fitted on the tier tray 10 or spacing support 12, and an inner curve or angle element 14 with horizontally extending line C of curvature and vertically extending surface line H is fitted on the complementary spacing support 12 or tier tray 10, the inner curve or angle element 14 having its outer face 14*b* abutting the interface 16*a* of the outer curve or angle element 16**.

On the inner surface **16*a* of the outer angle element 16 there are formed engagement dogs 20 which are intended to engage in engagement recesses 22 located on the outer surface 14*b* of the inner angle element 14. Located on the outer angle element 16 are stop strips 24 which form stop faces 24*a*. The inner curve or angle element 14 comprises end faces or counter-stop faces 26 which are intended to abut the stop faces 24*a***.

FIG. 3 depicts a top view of the inner angle element 14 inserted into the outer angle element 16, so that the outer face **14*b* of the inner angle element 14 rests on the inner face 16*a* of the outer angle element 16 and the engagement dogs 20 of the outer angle element 16 are engaged in the engagement recesses 22 of the inner angle element 14. Due to the engagement of the engagement dogs 20 in the engagement recesses 22, the spacing support 12 is secured in the vertical direction in relation to the tier tray 10. As shown by FIG. 3, uncoupling of the inner angle element 14 from the outer angle element 16 is possible only when either continuation 12*b* or 12*c* is bent elastically inwards in the direction of the arrow B according to FIG. 3, so that the end face 26 is removed from its position opposite to the stop face 24*a* and thereupon the inner angle element 14 can be turned in the direction of the arrow D away from the outer angle element 16, thereby completely uncoupling inner angle element 14 from outer angle element 16. The manner in which the installation of the inner angle element 14 is placed within the outer angle element 16 is generally as follows: the inner angle element 14 is applied with the end face 26, placed at bottom right, against the stop face 24*a* and then the continuation 12*b* is slid over the stop strip 24, with pressure placed upon the stop strip 24, until the end face 26 snaps in behind the stop face 24*a*. In this embodiment, the outer 16 and inner curve or angle element 14** each has an approximately rectangular cross-section.

To enhance stability, engagement formations similar to the engagement dogs 20 and engagement recesses 22 between the outer angle element 16 and the inner angle element 14 may also be provided in an apex zone S. However, if the angle element 14 is fitted exactly into the angle element 16, so that the two end faces 26 rest simultaneously exactly abutting the stop faces **24*a*, and simultaneously the faces 14*b* and 16*a* likewise abut one another, then the coupling elements as represented in FIGS. 2 and 3 and previously described will be sufficiently stable. It is also to be noted that the engagement dogs 20 and 20*a* in FIG. 2 are offset in relation to one another in the direction of the curve line C in order to simplify production by casting. The slot 21 in the tier tray 10** also serves the same purpose.

The bending of the leg **12*b* in the direction of the arrow B in FIG. 3, which is necessary for separation of inner angle element 14 from outer angle element 16, may be effected in a preferred embodiment by having the right angle of the shank cross-section 12*a* brought in the direction as indicated by the bending arrows P in FIG. 2, thereby causing an acute angle in the shank cross-section 12*a*. Thus, it is generally unnecessary to insert a blade between the inner angle element 14 and the outer angle element 16 to disengage the connection therebetween. It will be necessary to use such a procedure to separate inner angle element 14 from outer angle element 16 only in the case of especially strongly formed shanks 12*a* of the spacing supports 12**.

Figure 4:
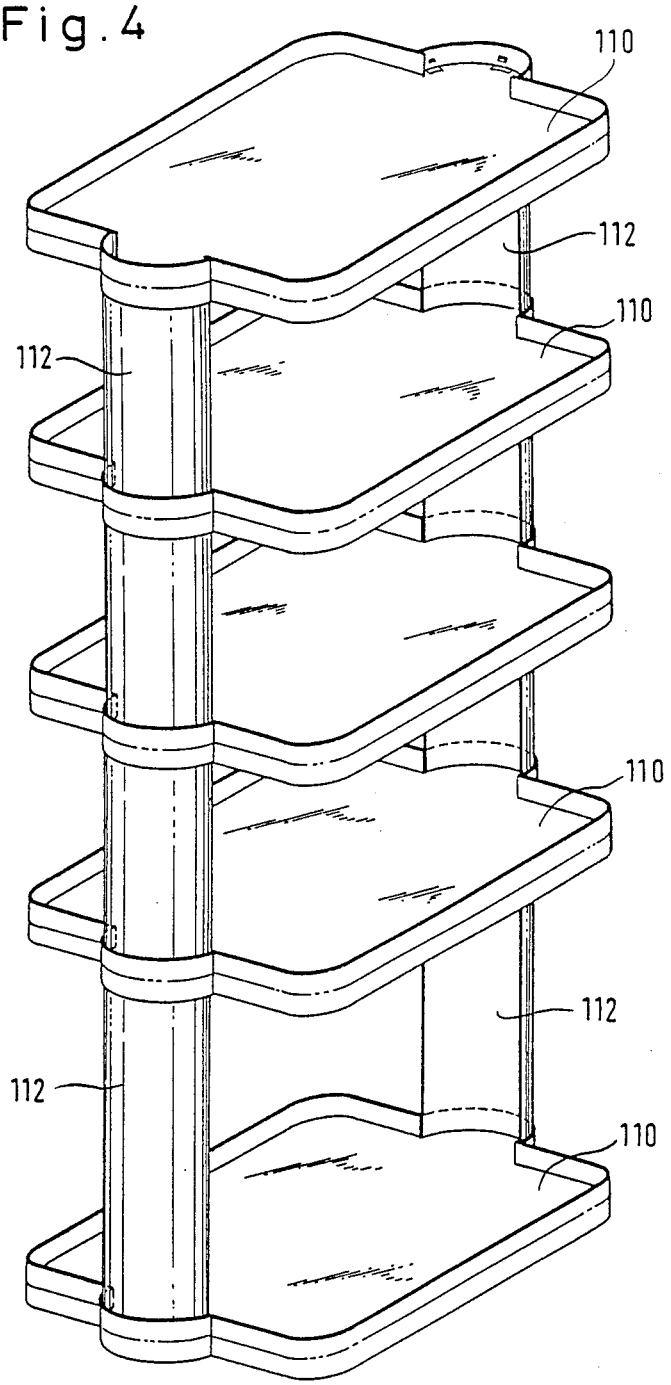
FIG. 4 shows another embodiment of a multi-tier tower with two spacing supports of channel form between each two successive tier trays.
Figure 5:
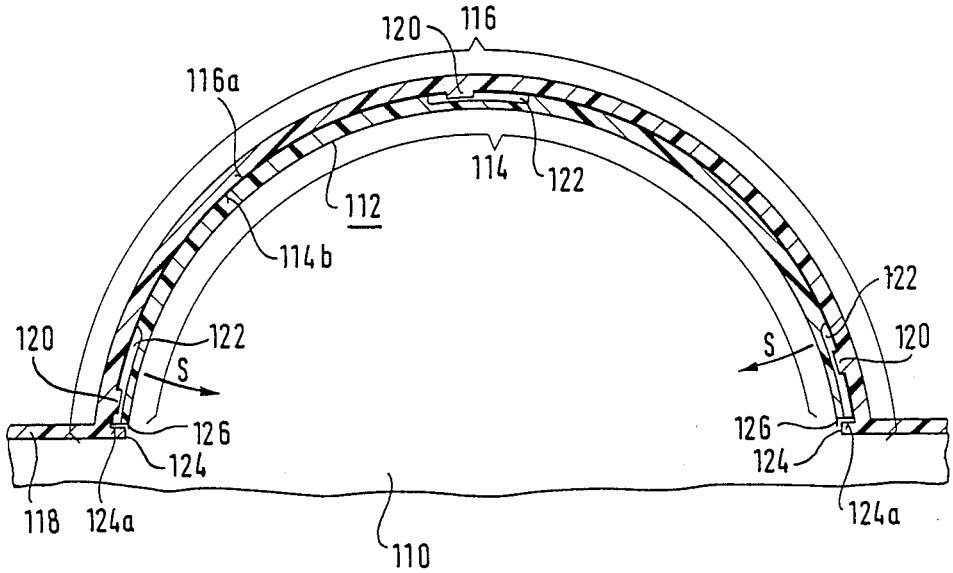
FIG. 5 shows the engagement of an inner curve element at end of a spacing support in an outer curve element on the edge flange of a tier tray.

In the case of the embodiment of the multi-tier tower according to FIG. 4, each two successive tier trays 110 are connected with one another by two spacing supports 112. The spacing supports 112 have the cross-section of semi-circular channels and are received in apsidal curvatures located in the middle of each of the two opposite sides of the tier trays 110. The connection of a spacing support 112 with a tier tray 110 is represented in FIG. 5. One end of the spacing support 112 forms an inner arch element 14, while the edge flange 118 forms an outer arch element 116 in the region of the apsidal extension. Engagement dogs 120 are formed on the inner face 116*a* of the outer arch element 116 for secure engagement with recesses 122 on the outer face 114*b* of the inner arch element 114. The outer arch element 116 comprises on its ends stop strips 124 with stop faces 124*a*, opposite to which there are abutted end faces 126 of the inner arch element 114.

To uncouple the inner arch element 114 from the outer arch element 116, the inner arch element is compressed in the direction of the arrows S-S, so that at least one of the end faces 126 may bypass the stop face 124*a*, whereupon the inner arch element 114 may be completely uncoupled from the outer arch element 116 by a turning movement.

Figure 6:
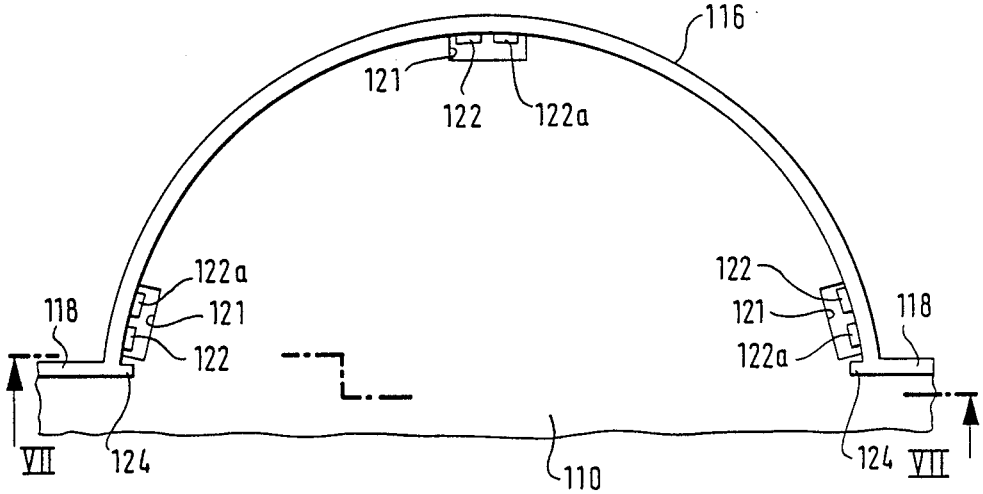
FIG. 6 shows a plan view of a tier tray in the region of an outer curve element.
Figure 7:
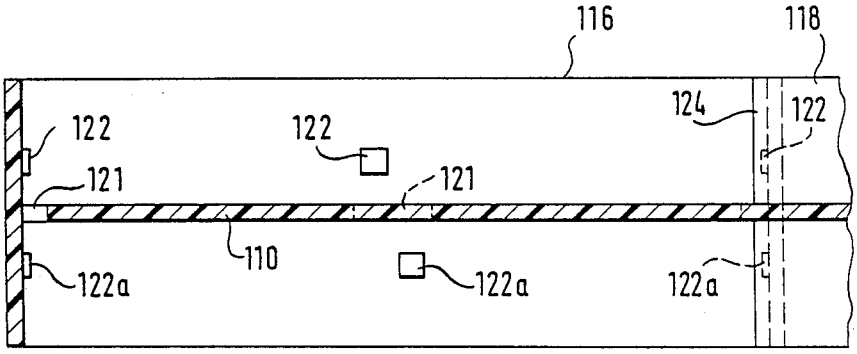
FIG. 7 shows a section along the line VII—VII of FIG. 6.

As depicted in FIGS. 6 and 7, the engagement dogs 122 and 122*a* and the slots 121 are circumferentially offset, and are selected with simplest possible form to facilitate production by casting.

Figure 8:
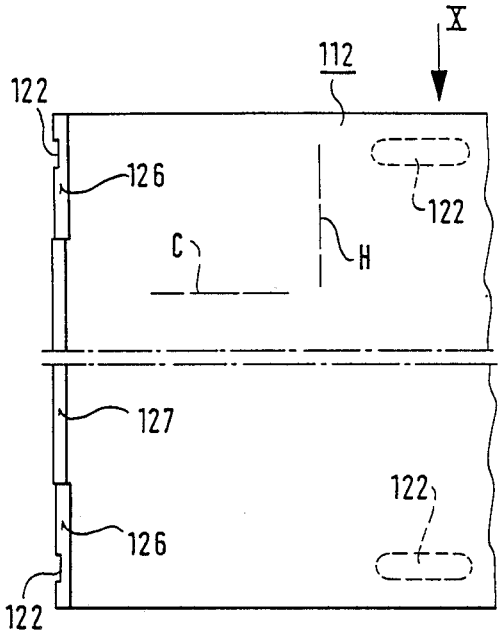
FIG. 8 shows a partial view of a spacing support for the embodiment of this invention according to FIG. 4 et seq., looking perpendicularly down onto the apex zone.
Figure 9:
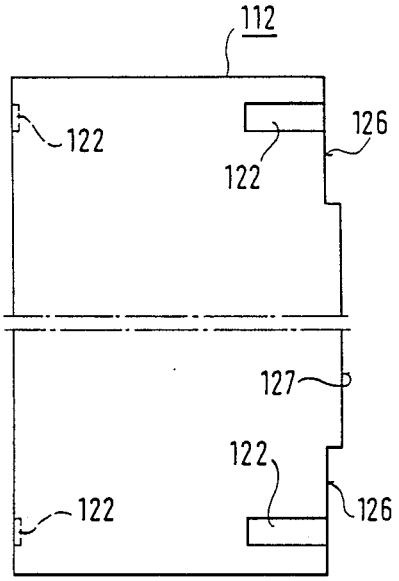
FIG. 9 shows a view of the spacing support according to FIG. 8.
Figure 10:
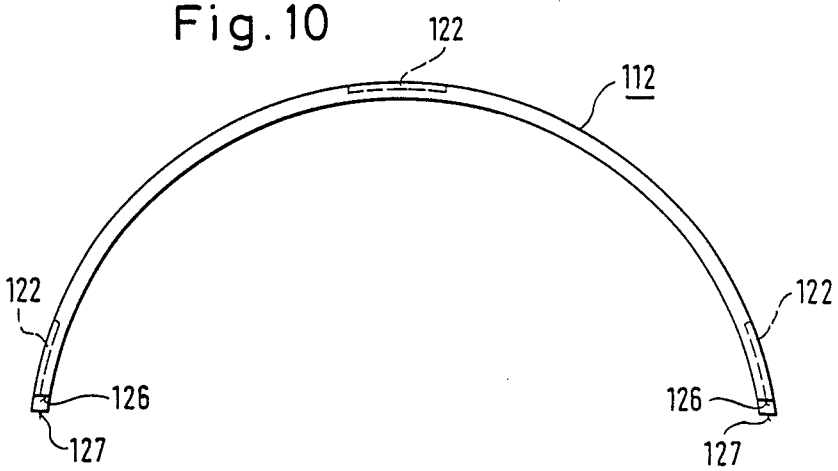
FIG. 10 shows a plan view of the spacing support according to FIGS. 8 and 9 in the direction of the arrow X in FIG. 8.

In FIGS. 8 to 10, the spacing support 112 is illustrated together with the engagement recesses 122 and the end faces 126 contained therein. The end faces 126 are slightly set back in relation to the longitudinal edges 127.

In either embodiment, the height of the curve or angle elements in the surface line direction H, and also the extent of the angle or curve elements in the direction C of curvature are responsible for the stability of the tower. The more precisely the curve or angle elements are employed, the smaller may be the extension of the surface line direction H and the curvature direction C.

Figure 11:
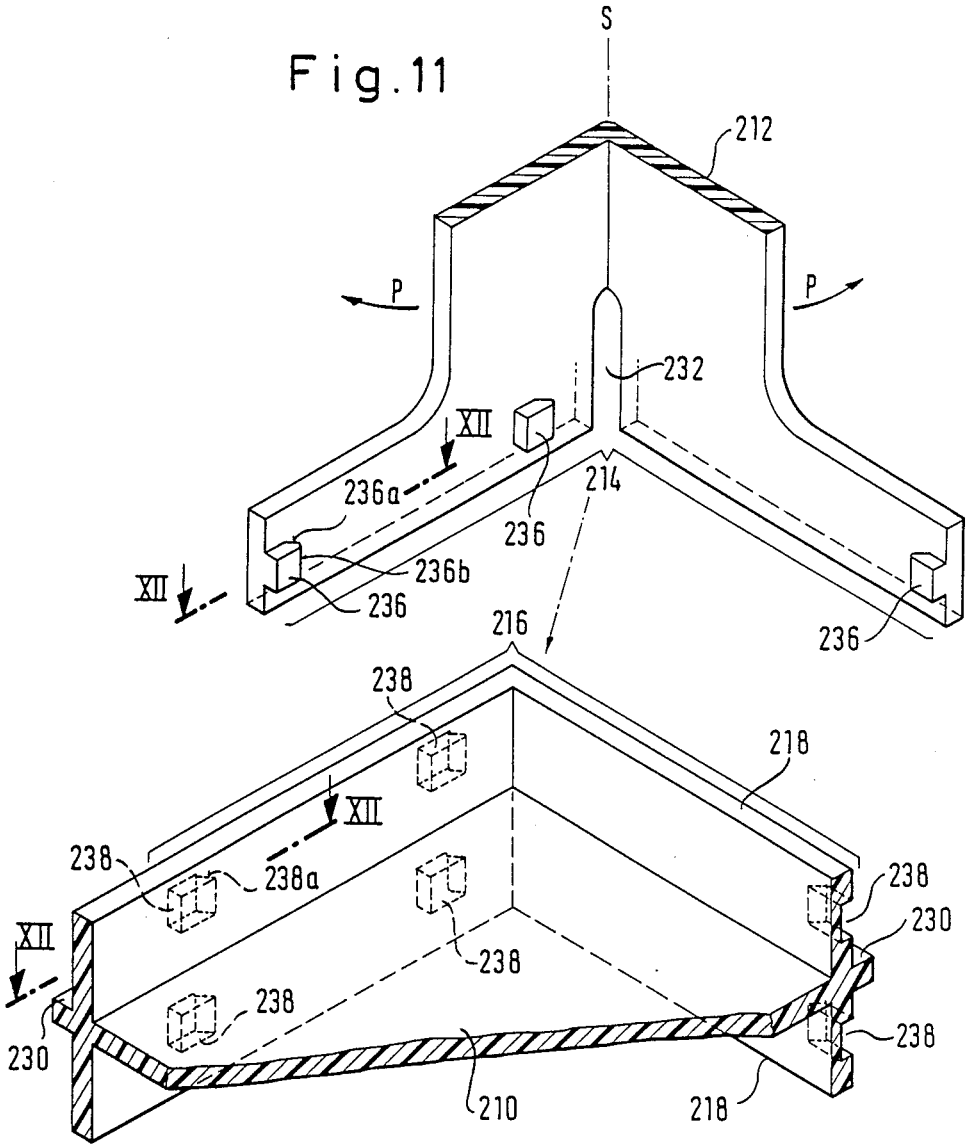
FIG. 11 an exploded representation of an embodiment in w angle elements of the spacing supports rest externally on an edge flange of the tier tray.
Figure 12:
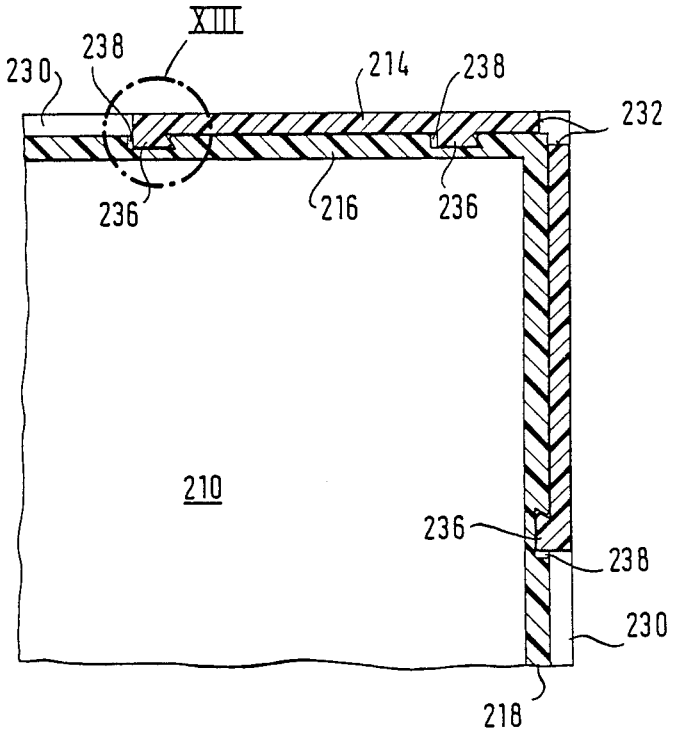
FIG. 12 shows a section along the line XII—XII in FIG. 11.

According to FIG. 11, a tier tray 210 comprises an edge flange 218 which forms an inner angle element 216. An outer angle element 214 is formed on a spacing support 212. The spacing support 212 stands on a stand strip 230 which is formed on the outer side of the edge flange 218 in the plane of the tier tray 210. The angle element 214 is provided in the apex region S with a slot 232. Two dogs 236 are fitted in the region of the ends of the outer angle element 214, and a further dog 236 is fitted in the vicinity of the apex, as shown. In the inner angle element 216 there are provided appropriate recesses 238 which are engaged by the dogs 236. In such engagement, the stop faces 236*a* engage behind the counter-stop faces 238*a*, which are both undercut. The dogs 236 comprise formed guide-in slopes 236*b* which facilitate the pressing of the dogs 236 into the recesses 238 in a press-stud manner. In the pressing of the dogs 236 into the recesses 238, the slot 232 is temporarily spread open elastically until the undercut stop faces 236*a* come into close abutment on the counter-stop faces 238*a*, which may also be undercut. The outer angle element 214 is thereby secured against vertical lifting away from the stand strip 230 by the dogs 236 inserted into the recesses 238. The co-operation of the three dogs 236 and the three recesses 238 further provides securing of the spacing supports 212 against tipping in relation to the tier tray 210. The inherent elasticity of the outer angle element 214 about the apex line S additionally ensures that the dogs 236 cannot release themselves from the recesses 238. For disengagement, it is instead necessary that the outer angle element 214 is bent up in the direction of the arrows P - P as shown and that simultaneously the undercut stop faces 236*a* are forced out of the counter-stop faces 238*a*; by this action the slot 232 may again spring open.

Figure 13:
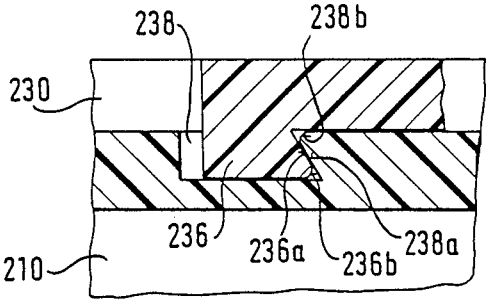
FIG. 13 an enlargement of XIII in FIG. 12.

In FIG. 13 there is depicted on an enlarged scale a dog 236 and its undercut stop face 236*a*, a recess 238 and its undercut counter-stop face 238*a*, and the guidein slopes 236*b* and 238*b*, respectively.

Figure 14:
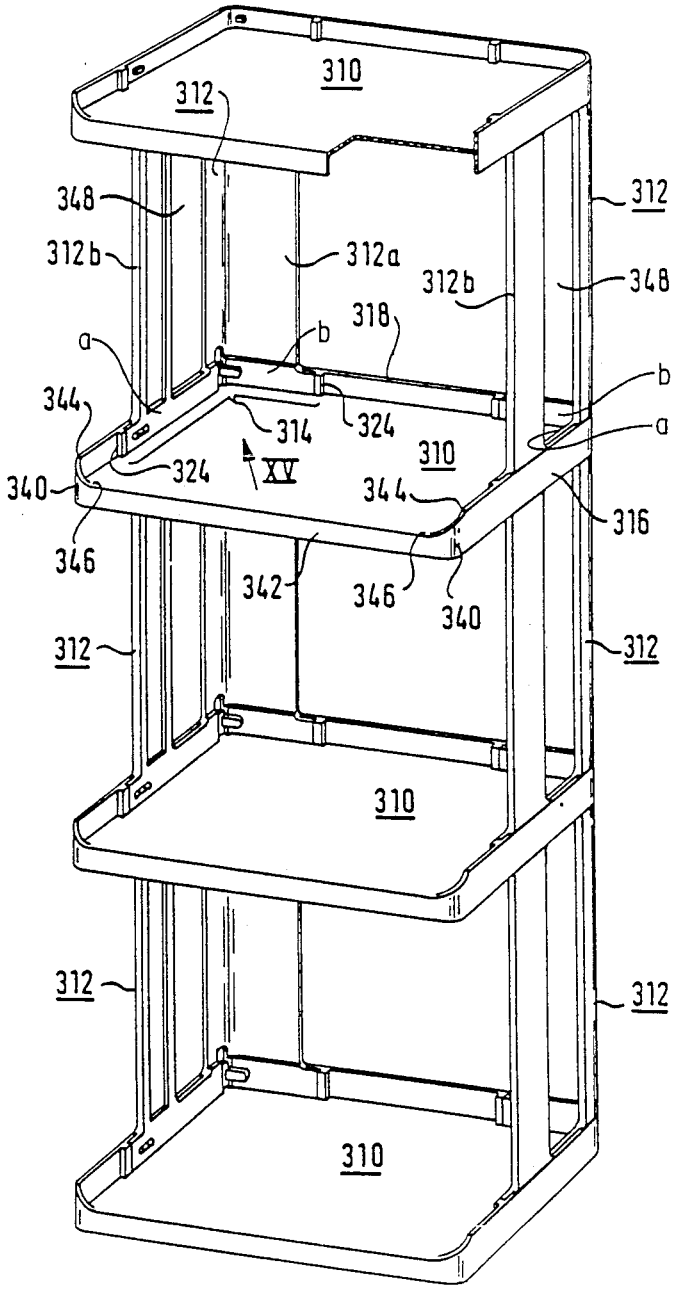
FIG. 14 shows another embodiment of a multi-tier tower having only two spacing supports which are in each case in adjacent corners of the tier trays.

In FIG. 14 a multi-tier tower consists of rectangular tier trays 310 and two spacing supports 312 in each case in two mutually adjacent corners of the tier trays 310. The spacing supports 312 each have two legs of different leg lengths, namely the legs 312*a* and the legs 312*b*. Inner angle elements 314, which are fitted on the inner side of outer angle elements 316 of the edge flange 318, are fitted on the ends of the spacing supports 312. The legs 312*b* lying in the region of the short rectangular sides are longer than the legs 312*a* lying in the region of the long rectangular sides. In this manner, the spacing supports 312*b* reach in the horizontal direction relatively close to the forward corners 340 in FIG. 14 of the tier trays 310 which are without spacing supports. The edge flange 318 extends only downwards on the front rectangular side 342 of tier tray 310. The spacing supports of the legs 312*b* are made with vertically elongated openings 348. In one embodiment, the long legs (312*b*) of the spacing supports (312) extend over at least 50% of the length of the short rectangular side of the tier trays (310).

Figure 15:
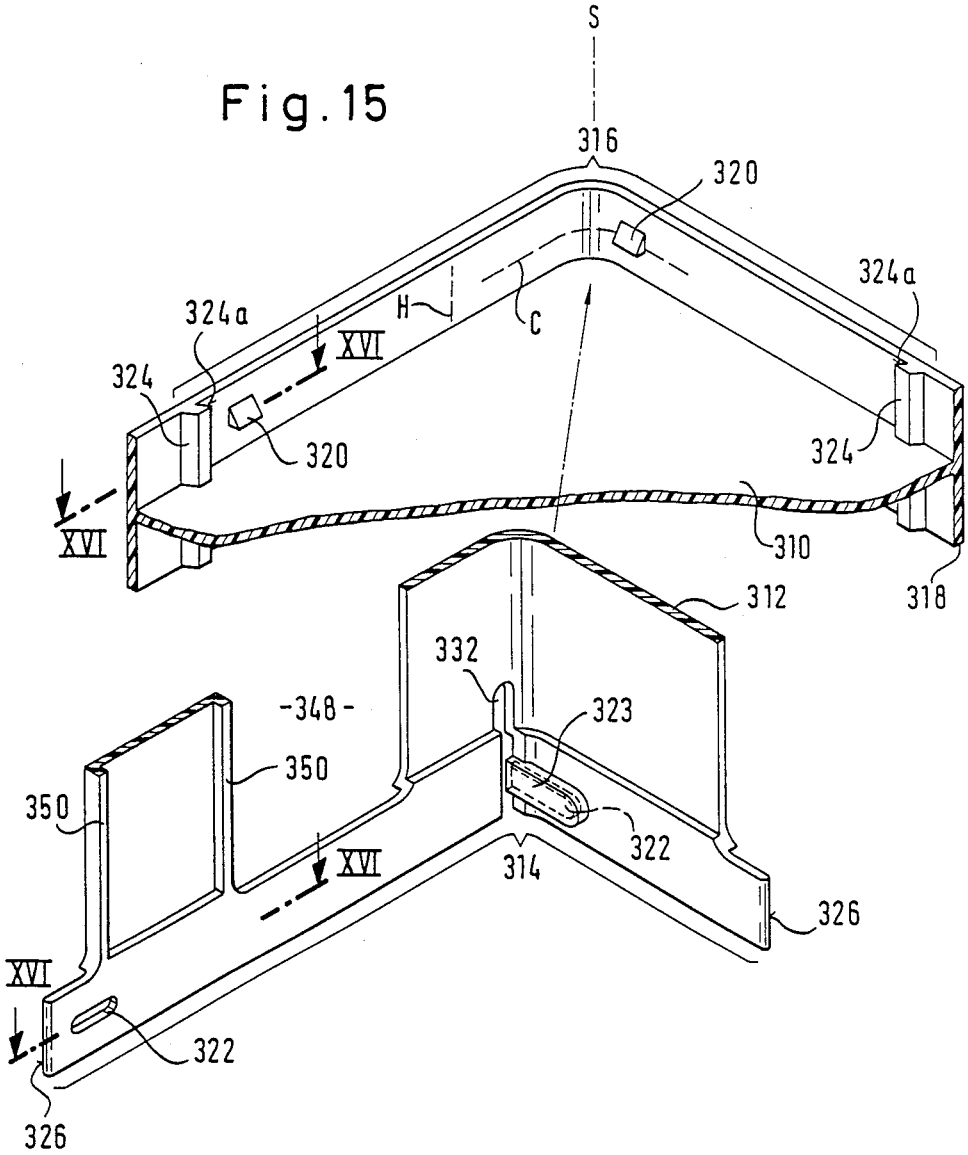
FIG. 15 shows an exploded representation of one corner at XV in FIG. 14.
Figure 16:
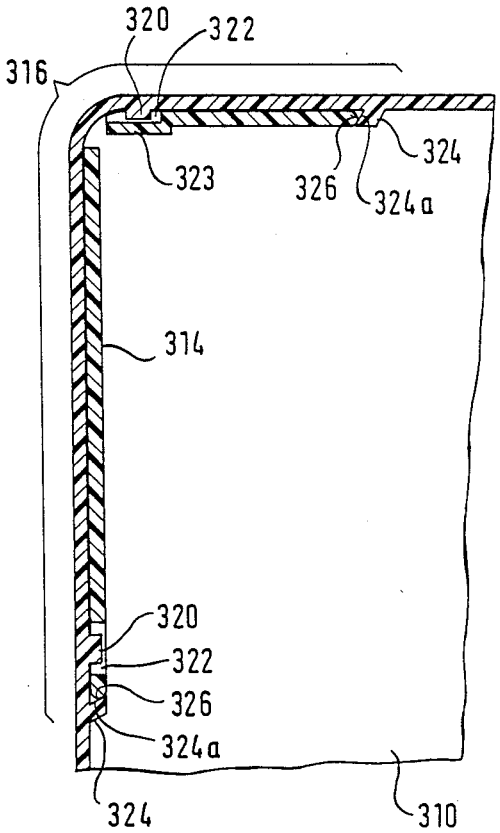
FIG. 16 shows a section along the line XVI—XVI in FIG. 15.

As may be seen from FIG. 15, the spacing supports 312 are stiffened by ribs 350. On the ends of the spacing supports there are provided inner angle elements-314 which possess rounded-off end faces or counter-stop faces 326 for undercutting engagement with stop faces 324*a*of stop strips 324.

On the outer angle element 316 there are provided dogs 320 which engage in recesses 322 of the inner angle element 314, thereby securing outer angle element 316 to inner angle element 314, and avoiding tilt. Note that one dog and recess pair 320 and 322 is provided close to the free end of the long leg and a further dog and recess pair 320 and 322 is provided in the vicinity of the apex S. The inner angle element 314 again has a slot 332 in the apex vicinity. In order to reinforce the recess which opens into the slot 332, it is provided with a lid 323.

Assembly and dismantlement take place in the manner as described previously with reference to FIGS. 2 and 3, while additional securing of the engagement between the counter-stop faces 326 and the stop faces 324*a* is guaranteed by their undercut form and by the elasticity of the slot 332, which ensures that the counter-stop faces 326 remain in abutment under initial pressure on the stop faces 324*a* once they have snapped in behind the stop faces 324*a*.

The term "line of curvature" was also used in FIG. 2 for the angle line visible therein as well as in FIG. 5. Thus, "line of curvature" is intended to cover both the actual line of curvature 116 in FIG. 5, and angle line 16 in FIG. 2.

I claim:

1. A multi-tier tower for goods display, having a plurality of tier trays (10) and having at least one vertical spacing support (12) of separate construction between each two successive tier trays (10), the at least one vertical spacing support (12) having two ends, wherein one end of the spacing support (12) is coupled to the respective tier tray (10) by means of an outer angle element (16) with horizontally extending line (C) of curvature and vertically extending surface line (H) fitted on the tier tray (10) or spacing support (12), and an inner angle element (14) with horizontally extending line (C) of curvature and vertically extending surface line (H) fitted on the complementary spacing support (12) or tier tray (10), in which the spacing support (12) has legs (12*b*, 12*c*) pointing horizontally, on the ends, which form parts of the respective curve or angle element (14), the inner angle element (14) having its outer face (14*b*) abutting the inner face (16*a*) of the outer angle element (16), the outer angle element (16) and inner angle element (14) being fastened in the direction of the line (C) of curvature and in the direction of the surface line (H) by an engageable and disengageable shape-engaging connection (26, 24*a*, 22, 20), wherein the angle element (14) relating to the spacing support (12) is free on the furthest side from the angle element (16) of the tier tray (10) in such a manner that the angle element (14) relating to the spacing support (12) may be fastened and released solely by movement (B) perpendicular in relation to the vertically extending surface line H of the respective angle element (16) of the tier tray (10), and in which the inner angle element (14) has counter-stop faces (26) facing away from an apex (S) of line (C) of curvature, the counter-stop faces (26) abutting on stop faces (24*a*) of the outer angle element (16), the stop faces 24(*a*) facing towards the apex (S) of the respective line (C) of curvature.

2. A multi-tier tower according to claim 1, in which the legs (12*b*12*c*) of the angle element (14) relating to the spacing support (12) are pivotable in relation to one another against elastic resistance about the respective apex line (S).

3. A multi-tier tower according to claim 1, in which a slot (332) is provided in the apex region (S) of the angle element (314) relating to the spacing support (312).

4. A multi-tier tower according to claim 1, in which counter-stop faces (26) of the inner angle element (14) relating to the spacing support (12) are formed by counter-stop faces (26) of the legs (12*b*, 12*c*) of angle element (14), and the relating stop faces (24*a*) of the outer angle element (16) of the tier tray (10) are formed by stop strips (24).

5. A multi-tier tower according to claim 1, in which the counter-stop faces (238) and the stop faces (236*a*) are each formed by a pairing of a dog (236) and a recess (238) of the mutually adjoining faces of the outer and the inner angle elements (214, 216).

6. A multi-tier tower according to claim 1, in which the counter-stop faces (326) are undercut.

7. A multi-tier tower according to claim 6, in which the counter-stop faces (326) are provided with a guide-in slope.

8. A multi-tier tower according to claim 1, in which the stop faces (324*a*) are undercut.

9. A multi-tier tower according to claim 8, in which the stop faces (324*a*) are provided with a guide-in slope.

10. A multi-tier tower according to claim 1, in which the angle elements (14, 16) are substantially curved angle elements having a substantially and continuously curved line (C) of curvature.

11. A multi-tier tower for goods display having a plurality of tier trays (310) and having at least one vertical spacing support (312) of separate construction between each two successive tier trays (310), wherein at least one end of the spacing support (312) is disengageably coupled to the respective tier tray (310) by means of an outer angle element (316), with horizontally extending line (C) of curvature and vertically extending surface line (H), carried by one of the tier tray (310) and spacing support (312), and an inner angle element (314), with horizontally extending line (C) of curvature and vertically extending surface line (H), carried by the other of the spacing support (312) and tier tray (310), the inner angle element (314) having its outer surface resting on the inner surface of the outer angle element (316) in the direction of line (C) of curvature and surface line (H) by a shape-engaging connection (324*a*, 326, 320, 322), wherein the tier trays (310) are substantially rectangular in shape and spacing supports (312) are provided only in two mutually adjacent corners.

12. A multi-tier tower according to claim 11, in which the inner angle element (14) is fitted on the spacing support (12) and the outer angle element (16) is fitted on the tier tray (10).

13. A multi-tier tower according to claim 11, in which the outer angle element (214) is fitted on the spacing support (212) and the inner angle element (216) is fitted on the tier tray (210).

14. A multi-tier tower according to claim 11, in which the angle element (16) of the tier tray (10) is formed by a part of an encircling flange (18) of the tier tray (10).

15. A multi-tier tower according to claim 11, in which the outer (16) and the inner angle element (14) each have an approximately rectangular cross-section.

16. A multi-tier tower according to claim 11, in which the spacing support (12) has an angle cross-section in the region of a shank (12*a*) for adapting to the respective angle element (14).

17. A multi-tier tower according to claim 11, in which the spacing support (12) has legs (12*b*, 12*c*) pointing horizontally, on the ends, which form parts of the respective angle element (14).

18. A multi-tier tower according to claim 11, in which the spacing supports (112) have over their entire height a cross-section approximately corresponding to the cross-sectional form of the angle elements (114).

19. A multi-tier tower according to claim 11, in which the spacing supports (312) and the relating angle elements (314) have first short legs and second long leg lengths, the first short legs (312*a*) of the two spacing supports being of equal length and aligned with each other, and the second long legs (312*b*) of the spacing supports also being of equal length and parallel with each other.

20. A multi-tier tower according to claim 19, in which the second long legs (312*b*) of the spacing supports (312) lie along a short rectangular side of the tier trays (310) and the first short legs (312*a*) of the spacing supports (312) lie along a long rectangular side of the tier trays (310).

21. A multi-tier tower according to claim 19, in which the second long legs (312*b*) of the spacing supports (312) extend over at least 50% of the length of a short rectangular side of the tier trays (310).

22. A multi-tier tower according to claim 19, in which the spacing supports (312) have openings (348).

23. A multi-tier tower according to claim 22, in which the openings (348) are formed in the region of the second long legs (312*b*) of the spacing supports (312).

24. A multi-tier tower according to claim 22, in which the openings (348) are elongated in the vertical direction of the spacing supports (312).

25. A multi-tier tower according to claim 22, in which the openings (348) extend substantially over the entire height of the spacing supports (312) between the related angle elements (314).

26. A multi-tier tower according to claim 19, in which the spacing supports (312) have stiffening ribs (350).

27. A multi-tier tower according to claim 19, in which the inner angle elements (314) of the spacing supports (312) each comprise, on the ends of the two legs (312*a*, 312*b*) of different lengths, a counter-stop face (326) for engagement with a stop strip (324) on the related outer angle element (316) of the tier tray (310), and pairings of inter-engaging dogs (320) and recesses (322) are provided for in the region of the free end of the long leg (312*b*) of the angle element (314) of the spacing support (312) and in the zone (S) adjacent to an apex of the short leg (312*a*) of the angle element (314) of the spacing support (312).

28. A multi-tier tower according to claim 19, in which the tier trays (310) have an edge flange (318) extending vertically above and below tier tray (310) along three mutually adjoining rectangular sides and have an edge flange which protrudes substantially below but not above tier tray (310) on the fourth side (342), remote from the spacing supports (312).

29. A multi-tier tower according to claim 28, in which the portion of the edge flange (318) extending above tier tray (310) extends into the same plane as tier tray 310 in the region of the fourth rectangular side (342), with the intersection of the upwardly extending portion of the edge flange (318) and tier tray (310) having rounded corners (344, 346).

30. A multi-tier tower according to claim 25, in which stiffening ribs (350) are located along the edges of the openings (348).

31. A multi-tier tower according to claim 26, in which the stiffening ribs (350) are located along the edges of the spacing supports (312).

32. A multi-tier according to claim 11, in which the angle elements are secured in the direction of the surface line (H) by inter-engaging dogs (20) and recesses (22) on the mutually adjoining faces (16*a*, 14*b*) of the angle elements (16, 14).

33. A multi-tier tower according to claim 11, in which the inner and outer angle elements (216, 214) are secured to one another by connections (236, 238) of press-stud type.

34. A multi-tier tower according to claim 11, in which at least one angle element (314) of each spacing support (312) has a slot (332) in the apex between adjacent legs of said angle element (314), said slot (332) permitting movement of one of the legs along a horizontal longitudinal axis thereof with respect to the respective other leg against an elastic resistance, said movement permitting engagement and disengagement of respective coupling elements (326,322; 324,320) coupling said curve or angle element (314) with the respective tray (310), said coupling elements (326,322; 324,320) being secured with respect to each other in the engaged condition by an elastic force resulting from such movement.

35. A multi-tier tower according to claim 11, in which the legs (a,b) of the two respective angle elements (314) connected with a tier tray (310) are of different length, respective first legs (b) of both angle elements (314) are equal in length and mutually aligned and respective second legs (a) of both angle elements (314) are equal in length and mutually parallel, the length of said mutually parallel legs (a) being larger than the length of said mutually aligned legs (b).

36. A multi-tier tower according to claim 16, said trays (310) being provided with a base plate of rectangular circumference and with a circumferentially extending flange (318) along the four sides of said rectangular circumference, said flange (318) being directed upwards and downwards from said base plate along the sides joining each other in the two mutually adjacent corners defining said curve or angle elements (316) of said tier trays (310) on both side faces of the respective base plate, and said flange (318) being directed substantially only downwards from said base plate along that side (342) of said rectangular circumference which is remote from said mutually adjacent corners.

37. A multi-tier tower according to either claim 1 or claim 11, in which the tier tray (10) is molded in one piece from a synthetic plastic material.

38. A multi-tier tower according to either claim 1 or claim 11, in which the spacing support (12) is molded in one piece from a synthetic plastic material.

39. A multi-tier tower according to claim 37, in which the synthetic plastic material is transparent.

40. A multi-tier tower according to claim 38, in which the synthetic plastic material is transparent.

* * * * *

UNITED STATES PATENT AND TRADEMARK OFFICE

CERTIFICATE OF CORRECTION

PATENT NO. : 4,961,506

DATED : Oct. 9, 1990

INVENTOR(S) : Lang

It is certified that error appears in the above-identified patent and that said Letters Patent is hereby corrected as shown below:

Col. 6, line 8, "guidein" should read --guide-in--;

line 25, after "342" insert -- , but extends both downwards and upwards on the other rectangular sides of the tier trays 310. The edge flange 318 tapers into the tier tray 310 by way of beveled corners 344 and 346 in the region of the front rectangular side 342--;

Col. 6, line 36, "324aof" should read --324a of--.

Col. 7, line 32, "(12b12c)" should read --(12b, 12c)--.

Col. 8, line 34, "angle" should read --angular--.

Col. 9, line 23, "claim 19" should read --claim 11--;

line 43, after "multi-tier" insert --tower--.

Col. 10, line 26, "claim 16" should read --claim 11--.

Signed and Sealed this

Seventeenth Day of March, 1992

*Attest:*

*Attesting Officer*

HARRY F. MANBECK, JR.

*Commissioner of Patents and Trademarks*